US005316049A

United States Patent [19]

Tremer

[11] Patent Number: 5,316,049

[45] Date of Patent: May 31, 1994

[54] LOCKING MECHANISMS FOR SELECTIVE RETENTION OF OSCILLATING LEVERS ENGAGED BY KNIVES IN A DOBBY

[75] Inventor: Siegmund H. Tremer, Eckersdorf, Fed. Rep. of Germany

[73] Assignee: Staubli & Trumpelt GmbH Maschinenfabrik, Bayreuth, France

[21] Appl. No.: 43,749

[22] Filed: Apr. 7, 1993

[30] Foreign Application Priority Data

Apr. 28, 1992 [FR] France ..... 92 05481

[51] Int. Cl.[5] ..... D03C 1/06

[52] U.S. Cl. ..... 139/69; 139/66 R

[58] Field of Search ..... 139/66 R, 66 T, 69, 139/70, 71, 72

[56] References Cited

U.S. PATENT DOCUMENTS 5,031,667 7/1991 Palau et al. ..... 139/71

5,131,436 7/1992 Tremer ..... 139/69

FOREIGN PATENT DOCUMENTS 130027 5/1901 Fed. Rep. of Germany ..... 139/69

*Primary Examiner*—Andrew M. Falik

*Attorney, Agent, or Firm*—Dowell & Dowell

[57] ABSTRACT

In a heavy closed-shed dobby of a weaving machine having oscillating levers which are selectively connected to one of two oppositely movable actuation knives by rocking double hooks mounted thereto so as to control the movement of heddle frames to which the levers are connected, a pair of locking members pivotally mounted to each lever. An elastic element is provided to urge one end of each locking member toward abutting engagement with a double hook thereby preventing pivotable movement of the double hook when engaged by one of the knives. The locking members are released from engagement with the double hook upon simultaneous engagement of the knives with a lever.

6 Claims, 3 Drawing Sheets

LOCKING MECHANISMS FOR SELECTIVE RETENTION OF OSCILLATING LEVERS ENGAGED BY KNIVES IN A DOBBY

BACKGROUND OF THE INVENTION

1. Field of the Invention

The present invention relates to heavy dobbies used for forming the shed in weaving machines of very large width, of the type particularly employed for manufacturing tubular fabrics for the production of endless dryer felts or filters for the paper-making industry.

2. History of the Related Art

Due to the considerable amplitude of the stroke of the heddle frames associated with these dobbies, the conventional open-shed systems cannot be used and closed-shed dobbies must be employed in which each frame moves downwardly or upwardly from a mean position corresponding to the point of crossing of the assembly of the frames.

FIG. 1 of the accompanying drawings schematically shows the general arrangement of the heavy closed-shed dobbies known in practice. Each of the heddle frames CL mounted on the weaving machine is connected by a system of rods 1 to a corresponding oscillating lever 2, articulated at 2*a* on the fixed frame. One of the ends of each lever 2 is provided with a freely rotatable stop 2*b*. Each lever is connected with a double rocking hook 3 whose pivoting movement is controlled by pushers (arrows 4) of the reading mechanism of the dobby in order to selectively engage with one or the other of two actuation knives 5. The knives are controlled to move reciprocally in unison in opposite directions.

Actuation of the assembly of the double hooks 3 by the reading mechanism is effected when the two knives 5 lie in a central position (levers 2 oriented vertically) and it will be understood that, depending on whether a hook cooperates with one or the other of the knives 5, the corresponding frame CL moves vertically upwardly or downwardly from the position corresponding to the closure of the shed.

Although such a system functions relatively correctly when the work speed is reduced, this does not apply when the dobby is associated with a weaving machine driven at the high rates now required in practice. In such a case, the double hooks are subjected to the effects of rebound and vibrations which render their engagement by the driving knives random. Furthermore, the pushers 4 have only a very short period of time to act on the double hooks and it happens that the double hooks pivot with a very slight delay. Now, in either case, any defective engagement of one of the double hooks 4 by a knife 5 results in a defect in weaving in the article being made.

It is a principal object of the present invention to overcome these drawbacks.

SUMMARY OF THE INVENTION

To that end, the present invention relates to a heavy closed-shed dobby of the type comprising two actuation knives which are reciprocally moved in opposite directions to cooperate selectively, under the effect of pushers of the reading mechanism of the dobby, with a rocking double hook carried by each of the oscillating levers which are coupled to the heddle frames of the corresponding weaving machine. Each oscillating lever includes two movable locking members which are associated with elastic return elements which tend to urge the locking members laterally against the corresponding rocking double hook in order to immobilize the double hook to prevent it from pivoting when it has been engaged by an actuation knife, and which elements assure the release of the double hook at the moment of the control or selection which is the moment when the two knives come simultaneously into contact with the oscillating lever.

According to a preferred embodiment of the foregoing arrangement, the elastic elements associated with the locking members exert on each rocking double hook a force of angular retention greater than the force of pivoting applied to the hook by the pushers of the reading mechanism. In this manner, the pushers may begin to act on the hook before the oscillating lever has arrived in the position of selection, consequently allowing the pre-selection of the hook.

BRIEF DESCRIPTION OF THE DRAWINGS

The invention will be more readily understood on reading the following description with reference to the accompanying drawings, in which.

As indicated hereinabove, FIG. 1 schematically illustrates the general arrangement of a closed-shed dobby of conventional type.

DETAILED DESCRIPTION OF THE DRAWINGS

Figure 1:
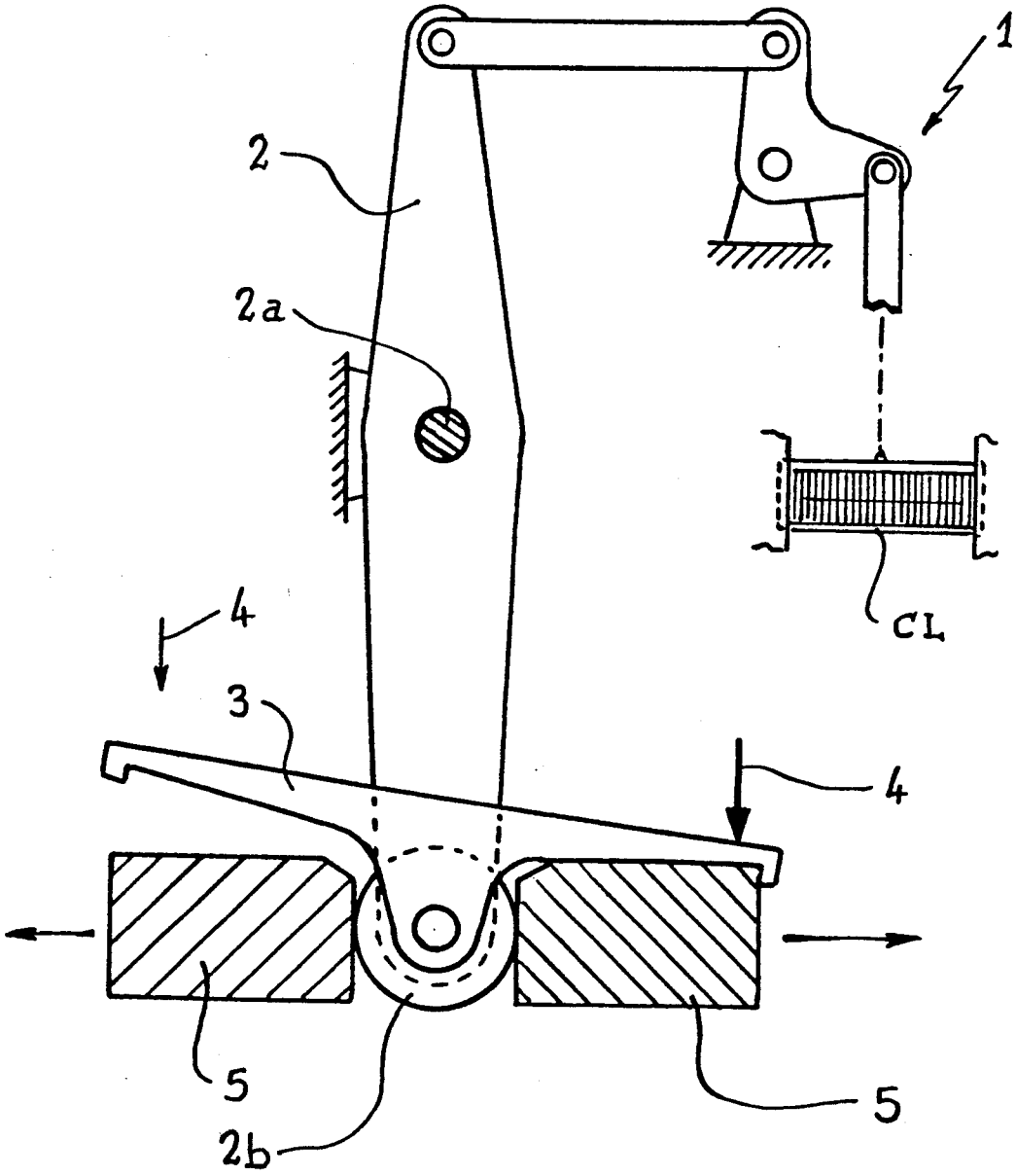
Fig. 1 PRIOR ART
Figure 2:
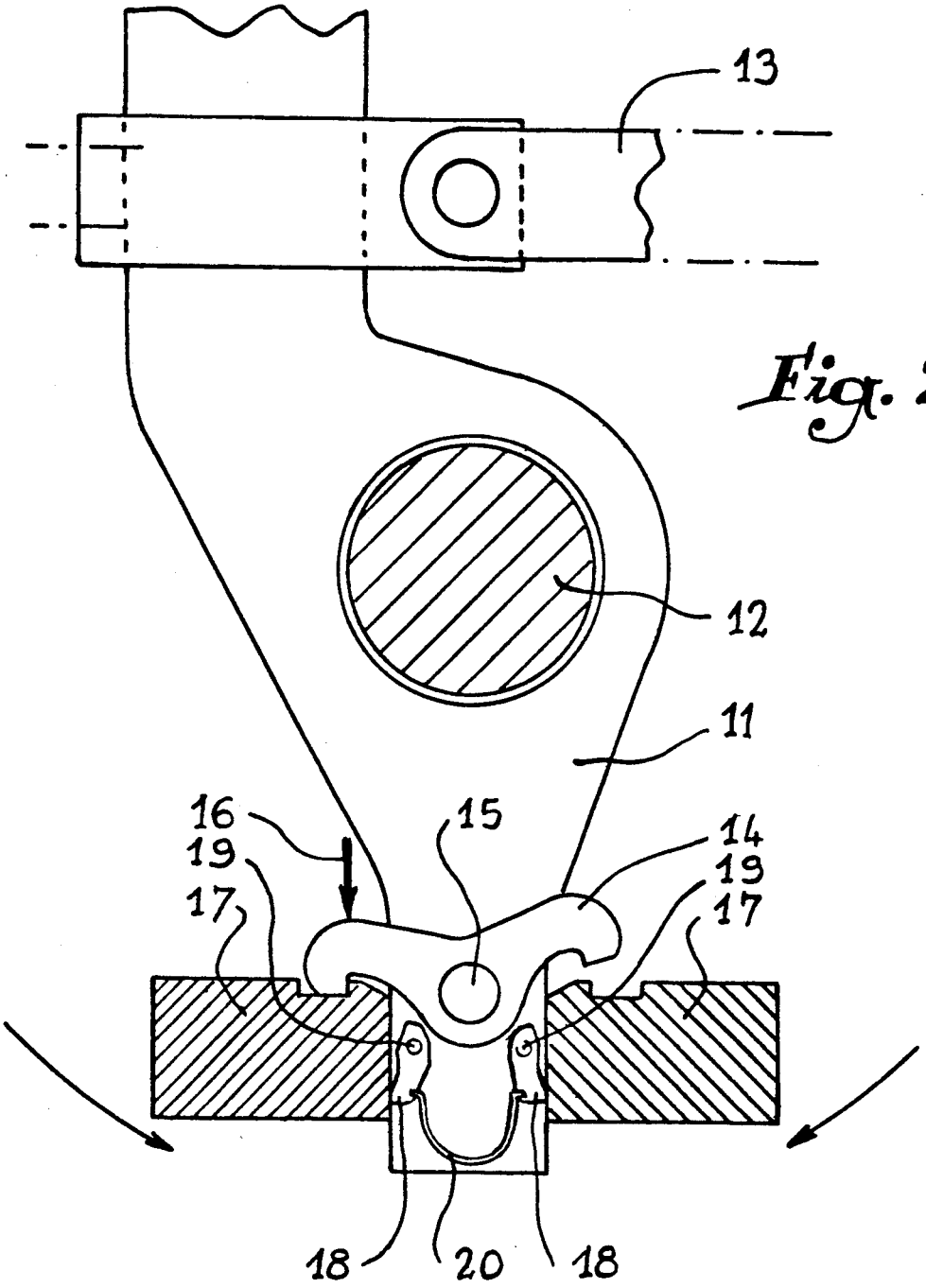
FIG. 2 similarly shows the arrangement of a dobby according to the invention.
Figure 3:
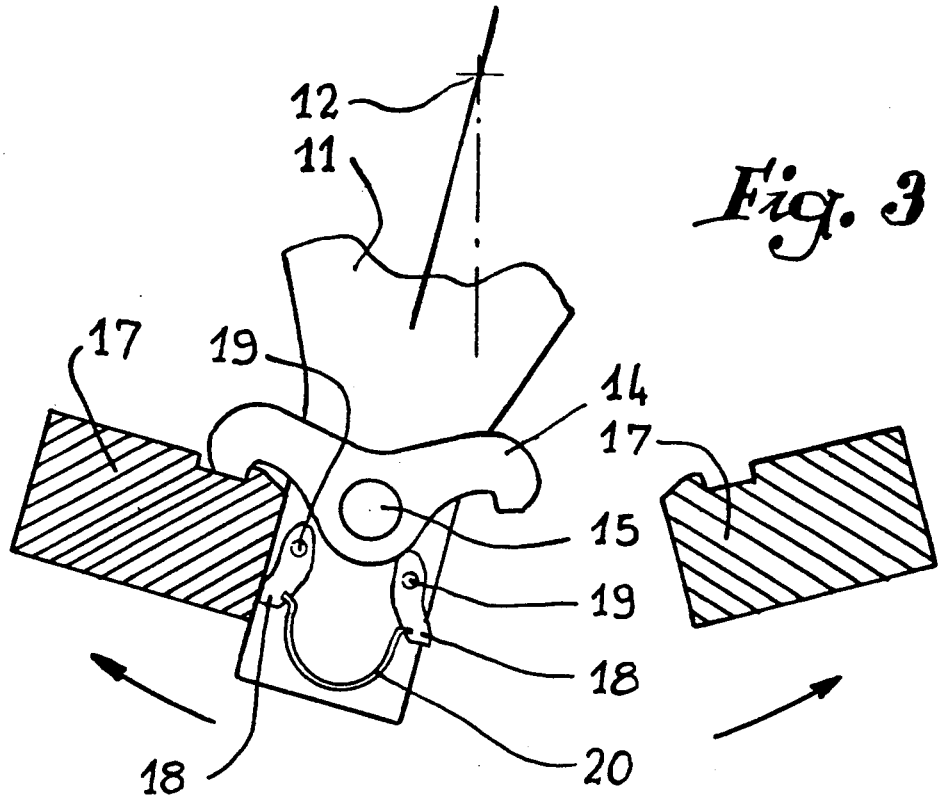
FIGS. 3 and 4 illustrate two phases of operation of the dobby according to FIG. 2.
Figure 4:
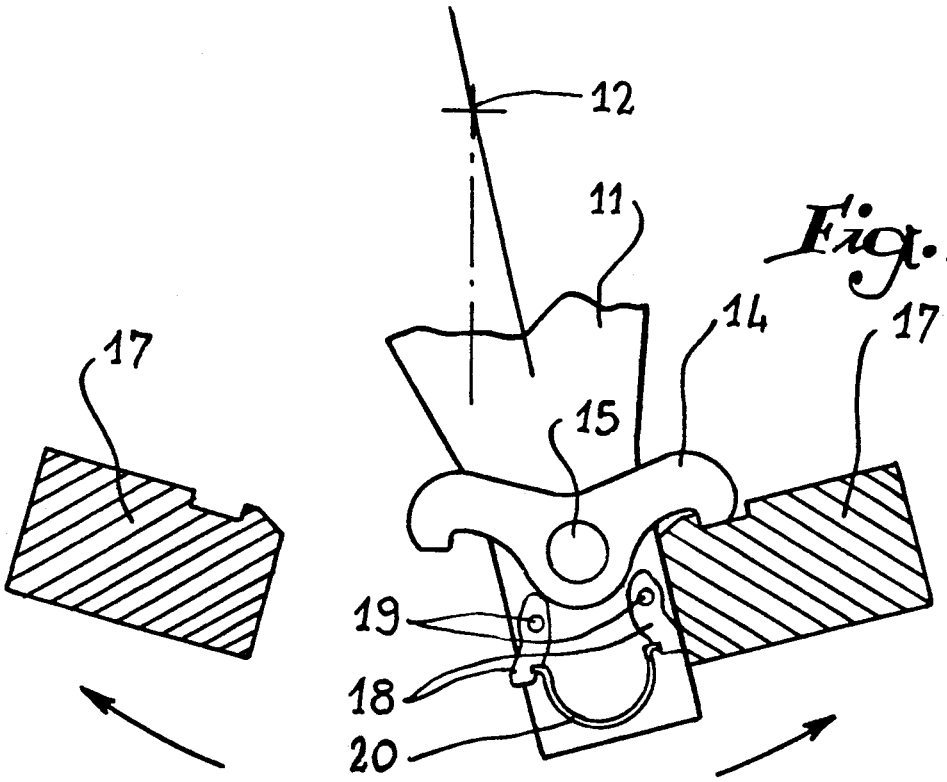

Referring again to the drawings, in FIGS. 2 to 4, reference 11 designates one of the rocking levers which are mounted to pivot on a common pin 12 and which are coupled by a system of rods 13 to the different heddle frames of the corresponding weaving machine. Opposite the system of rods 13, each lever 11 carries a double hook 14 which is mounted to rock on a small pin 15 and which is intended to receive the action of two pushers (arrow 16) of the reading mechanism of the dobby to come into engagement with one or the other of two actuation knives 17.

These knives 17 are actuated so as to move reciprocatingly in opposite directions with respect to each other. It has been assumed, in the present case, that these knives 17 move along a semi-circular path having the common pin 12 as its center.

With each double hook 14 are associated two movable locking members constituted by two small friction pads 18 which pivot on pins 19 provided laterally on the lever 11 on either side of pin 15 and which are connected to each other by a leaf spring 20 of articulate profile of which the ends are connected to the pads. This spring 20 tends to move apart the actuation edges of the two pads 18 in order to apply their upper ends against the rounded lower part of the double hook 14. It will be noted that, in this working position, the actuation edges project beyond the profile of the lower ends of the rocking levers 11.

Under these conditions, it will be readily appreciated that, when a rocking lever 11 is oriented vertically as illustrated in FIG. 2, with the two knives 17 applied against the lower end of the lever 11, the pads 18 are pushed towards the center by the knives and consequently exert no retaining effect on the corresponding hook 14. The hook is therefore free to pivot under the effect of one or the other of the two pushers 16 in order to come into engagement with a knife 16 which was selected by the reading mechanism (left-hand knife in the example shown in FIG. 2).

The rocking lever 11 is consequently driven by knife 17 and moves towards the left, in the manner illustrated in FIG. 3. The same effect is obviously produced when it is the opposite knife (to the right in the drawing) which has been selected, as shown in FIG. 4.

It should be observed that, in either case, the pad 18 facing opposite the knife 17 which controls the rocking lever 11 receives the action of the leaf spring 20 which applies it against the lower profile of the hook 14, which is thus prevented from pivoting during the entire rocking displacement of the lever 11.

If it is now assumed that spring 20 has been arranged so that it exerts on locking pad 18 a higher angular retaining force than the one applied by one or the other of the pushers 16 of the reading mechanism on the hook 14, it may be arranged for the chosen pusher 16 to begin to act on the hook 16 before the lever 11 has arrived in the vertical position of selection in accordance with FIG. 2. Of course, this hook will rock only when it has been released by the two pads 18, but such a structure allows the pre-selection of the hooks and the levers. The reading mechanism consequently has a longer period of time available for selection and any risk of defects in weaving is consequently avoided, even at the high operational speeds now required of dobbies.

The device according to the invention constituted by pads 18 and springs 20 therefore ensures positive locking of the hooks 14 (anti-rebound effect) and pre-selection thereof.

It goes without saying that other embodiments may be imagined for the movable members 18 and the elastic return elements 20.

What is claimed is:

1. In a heavy closed-shed dobby for a weaving machine which includes a pair of actuation knives which are reciprocally movable in opposite directions and which are selectively engagable with a double rocking hook pivotally mounted to an oscillating lever which is connected to a heddle frame of the weaving machine, a locking mechanism for selectively retaining the oscillating levers connected to one of the knives comprising, a pair of spaced pivotable locking members mounted to the oscillating lever, resilient means for urging each of said locking members toward the double rocking hook in such a manner that when the double rocking hook is engaged with one of the knives, one of said locking members will engage the double rocking hook to prevent the pivotal movement thereof, and said locking members being pivoted away from the double rocking lever when the knives are in simultaneous engagement with the oscillating lever.

2. The locking mechanism of claim 1 in which said locking members include a first end adjacent said double rocking hook and second end oriented toward one of the knives, a pivot means for mounting each of said locking members to the oscillating lever and disposed between said first and second ends thereof, said second ends being engagable by the knives as the knives approach the oscillating lever.

3. The locking mechanism of claim 2 in which said resilient means include a leaf spring means mounted between said locking members adjacent said second ends thereof.

4. The locking mechanism of claim 2 in which said locking members are friction pad means, said double rocking lever having an arcuate edge portion, and said first ends of said locking members being selectively engagable with said arcuate edge portion.

5. The locking mechanism of claim 4 including pusher means for selectively urging the double rocking hook into engagement with one of the knives under a first force, and the resilient means applying a force greater than said first force to pivot said first end of said friction pad means toward said double rocking hook.

6. The locking mechanism of claim 1 including pusher means for selectively urging the double rocking hook into engagement with one of the knives under a first force, and the resilient means applying a force greater than said first force to urge said locking members toward the double rocking hook.

* * * * *